US005443359A

United States Patent [19]

Miller et al.

[11] Patent Number: 5,443,359

[45] Date of Patent: Aug. 22, 1995

[54] APPARATUS FOR SEPARATING AND DELIVERING FLAT ARTICLES OF RANDOM LENGTH AND THICKNESS FROM A STACK

[75] Inventors: Charles M. Miller, Seven Valleys, Pa.; Mark W. Westerdale, Millersville, Md.; David J. Tilles, Baltimore, Md.; John O. Kurtz, Laurel, Md.

[73] Assignee: Westinghouse Electric Corp., Pittsburgh, Pa.

[21] Appl. No.: 61,384

[22] Filed: May 14, 1993

[51] Int. Cl.[6] ..... B65G 59/00

[52] U.S. Cl. ..... 414/798.9; 271/111; 271/114; 271/125

[58] Field of Search ..... 271/34, 111, 114, 125, 271/129; 414/797.6, 797.7, 798.9, 797.2, 797.3

[56] References Cited

U.S. PATENT DOCUMENTS

| | | | |
|---|---|---|---|
| 2,887,316 | 5/1959 | Tobey | 271/125 |
| 4,203,586 | 5/1980 | Hoyer | 271/125 X |
| 4,819,927 | 4/1989 | Noguchi et al. | 271/34 |
| 4,893,804 | 1/1990 | Sasage et al. | 271/111 X |
| 5,190,277 | 3/1993 | Rahman et al. | 271/35 |
| 5,190,282 | 3/1993 | Rabindran et al. | 271/272 |
| 5,192,068 | 3/1993 | Parker et al. | 271/34 |
| 5,201,508 | 4/1993 | Kuo | 271/10 |
| 5,211,388 | 5/1993 | Walluk | 271/122 |
| 5,238,236 | 8/1993 | Belec et al. | 271/34 |
| 5,273,269 | 12/1993 | Iwanaga | 271/124 |

FOREIGN PATENT DOCUMENTS

| | | | |
|---|---|---|---|
| 1366795 | 6/1964 | France | 271/34 |
| 111337 | 8/1980 | Japan | 271/125 |

*Primary Examiner*—Michael S. Huppert
*Assistant Examiner*—Janice L. Krizek
*Attorney, Agent, or Firm*—C. O. Edwards

[57] ABSTRACT

Apparatus for separating individual flat articles of random thickness from one end of a stack of such articles and delivering separated articles, on command, to a transport device. Included in the apparatus is a pick-off device having a friction surface drivable in a direction of article delivery and oriented to engage an exposed surface on one article at the one end of the stack and advance the one article in the direction of delivery, an anti-doubling device for restricting advancing movement of other articles by the pick-off device, a delivery device having a drivable friction nip for pulling a separated article from the pick-off device in the direction of article delivery, and a control system for operating the pick-off device and the delivery device to position each separated article in the friction nip in readiness for delivery, on command, to the transport device. The anti-doubling device is a friction roller supported for movement between a first position of contact with the friction surface of the pick-off device and a second position separated from the friction surface of the pick-off device by the thickness of an article advanced from the one end of the stack. A constant slip torque is imposed on the friction roller independent of friction roller speed, by a magnetic hysteresis device.

13 Claims, 4 Drawing Sheets

MOTOR SPEED
MOTOR ON/OFF
CLUTCH ON/OFF
BELT POSITION
SYSTEM CONTROL
98
88
90
92
48
50
54
84
80
76
96
44
68
74
94
70
32
22
18
24
16
20
28
26
12
60
66
14
10

APPARATUS FOR SEPARATING AND DELIVERING FLAT ARTICLES OF RANDOM LENGTH AND THICKNESS FROM A STACK

BACKGROUND OF THE INVENTION

The present invention relates to apparatus for separating and delivering flat articles of random thickness from a stack of such articles. More particularly, the invention relates to apparatus for separating such articles, one at a time from a stack, and delivering each separated article to a transfer device upon the occurrence of a command for individual article delivery.

In automated systems for handling flat articles of random size and thickness, such as mail pieces, two categories of article separator/feeders have been used traditionally, namely, fixed pitch and constant gap. In a constant gap feeding system, the feeder is designed to separate and feed a new article within a specific time frame after a previous article has been fed. This fixed time gap allows the maximum density of articles to be fed into a non-compartmented transport system within the capabilities of a particular feeder. The number of articles fed per unit time is inversely proportional to the average article length.

In transport systems which operate with compartments, such as conveyed trays or bins to receive separated articles, it is necessary to feed articles at a fixed pitch rate so that the articles will register with the respective compartments pre-designated to receive them. If a feeder is unable to deliver an article within an increment of time during which a compartment is available at the point of article delivery, a jam will occur and the transport system must be shut down to avoid damage to the article or the transport equipment.

Transport systems are further divided into two groups differentiated by the separation means employed to isolate and deliver individual articles from a stack, that is, direct friction or vacuum pickup. Each system has advantages and disadvantages and both types are common in flat article handling.

Both methods have proven to be unreliable where the article mix is high or where the interval between a feed command and article delivery is short. This latter condition is particularly evident in fixed pitch transport systems where timing of article feed is critical to jam-free operation. As a result, current fixed pitch systems are limited to very coarse pitch or very low speed.

Friction separators include systems where a prepared batch of flat articles, such as mail pieces, is presented to the separator as a stack, and a set of rollers or belts pick off, by friction, the foremost or first article while the article stack itself is held under pressure against the pick-off rollers or belts. However, as a stack is presented to the separator, the pick-off rollers or belts will not only pick off the foremost article but will also slide a number of the succeeding articles in the stack in lumps or in a step-like manner. The slip will occur at the point of least resistance, which may be several articles away. If no inhibiting gate is provided, many articles could be fed at once into the take-away system for delivery to a transfer apparatus.

To prevent separation and delivery of multiple articles, an anti-doubler roller, belt, friction pad, vacuum brake or other device is used to allow only the first, end most article to pass from the stack to a transfer conveyor or the like. Most anti-doubler devices presently used require an outside power source, such as electricity, vacuum, or air pressure. Such devices also can be unreliable due to the mass of the active article engaging device which prevents instant rebound to an anti-doubler position. In particular, when a thick article is followed by a thin smaller article in a high speed environment, the mass of the anti-doubler device inhibits instantaneous reaction to article thickness changes.

Some presently used anti-doubling devices function by rotating in the opposite direction of the movement required, thereby adding friction and power requirements. Also such devices can cause warping of an article when the article is very thin, causing misfeed and jams. A static friction pad, if used, does not require an outside power source, but wear or contamination of the pad on only one area presented at all times results in warping or otherwise damaged articles.

Separator/feeder manufacturers typically provide various methods of adjusting their pick-off assemblies. These adjustments are used to bias the friction separators toward the most common article types within the total mix. This permits tailoring the separator/feeder to provide the maximum thruput/lowest jam rate for a given article mix. On a friction separator this is accomplished by pressure adjustments within the various elements of the pick-off assembly. Typical of these is the pressure of the available stack of articles against the friction assembly, the pressure of the pick-off means against the anti-doubling means, and the pressure of a pinch/takeaway means in relation to each of the others.

Each of the previously mentioned adjustments must be made in an iterative and time consuming manner because each adjustment has an effect on the others. Problems occur, for example, when the effects of increasing the stack pressure in an attempt to improve traction against the pick-off device are negated by increased article-to-article friction in the stack. When any of these self-cancelling situations occur the limits of that particular separator have been reached. The whole procedure is done in an attempt to cause any feeder to perform reliably on the widest article mix. The limitations to these methods become more and more pronounced as the preferred article mix is being driven wider and wider by the industry economic requirements.

The industry has not demonstrated a friction type article feeder that can separate and feed mixed articles thicker than $\frac{3}{8}$ inch with enough accuracy to supply a fixed pitch transport machine reliably and economically.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention is directed to an apparatus for separating individual flat articles of random thickness from one end of a stack of such articles and delivering separated articles, on command, to a transport device. The apparatus comprises a pick-off device having a friction surface drivable in a direction of article delivery and oriented to engage an exposed surface on one article at the one end of the stack and advance the one article in the direction of delivery, an anti-doubling device for restricting advancing movement of other articles by the pick-off device, a delivery device having a drivable friction nip for pulling a separated article from the pick-off device in the direction of article delivery, and means for operating the pick-off device and the delivery device to position each separated article in the friction nip in readiness for delivery, on command, to the transport device.

In another aspect of the invention, the anti-doubling device of the apparatus summarized above comprises a friction roller and means supporting the friction roller for movement between a first position of contact with the friction surface of the pick-off device and a second position separated from the friction surface of the pick-off device by the thickness of an article advanced from the one end of the stack. A constant slip torque is imposed on the friction roller independent of friction roller speed, preferably by a magnetic hysteresis device.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DETAILED DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

In accordance with the invention, an apparatus is provided for separating individual flat articles of random thickness from one end of a stack of such articles for delivering separated articles, on command, to a transport device. Flat articles of random thickness may include, for example, mail pieces, magazines, a mixture of mail pieces and magazines, manuals, booklets, and the like. The apparatus of the invention includes a pick-off device having a friction surface drivable in the direction of article delivery and oriented to engage an exposed surface of one article on the end of the stack and advance the one article in the direction of delivery.

Figure 2:
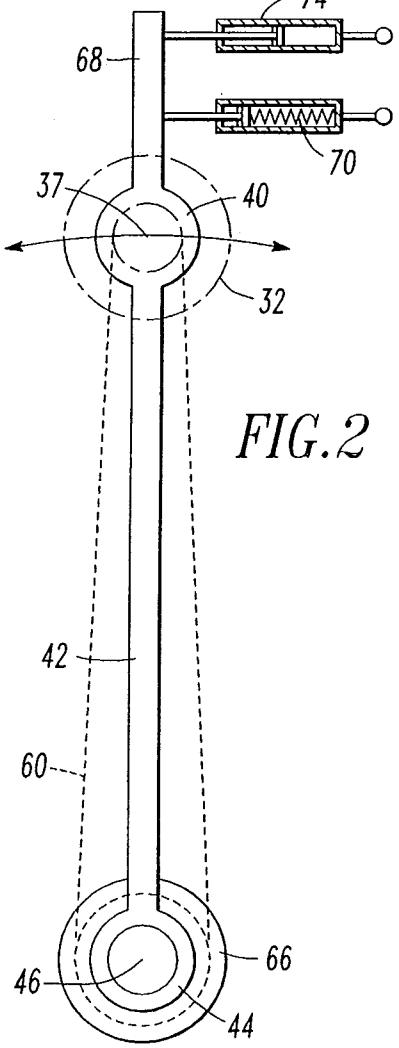
FIG. 2 is a plan view illustrating the components of an anti-doubling device used in the exemplary embodiment.
Figure 1:
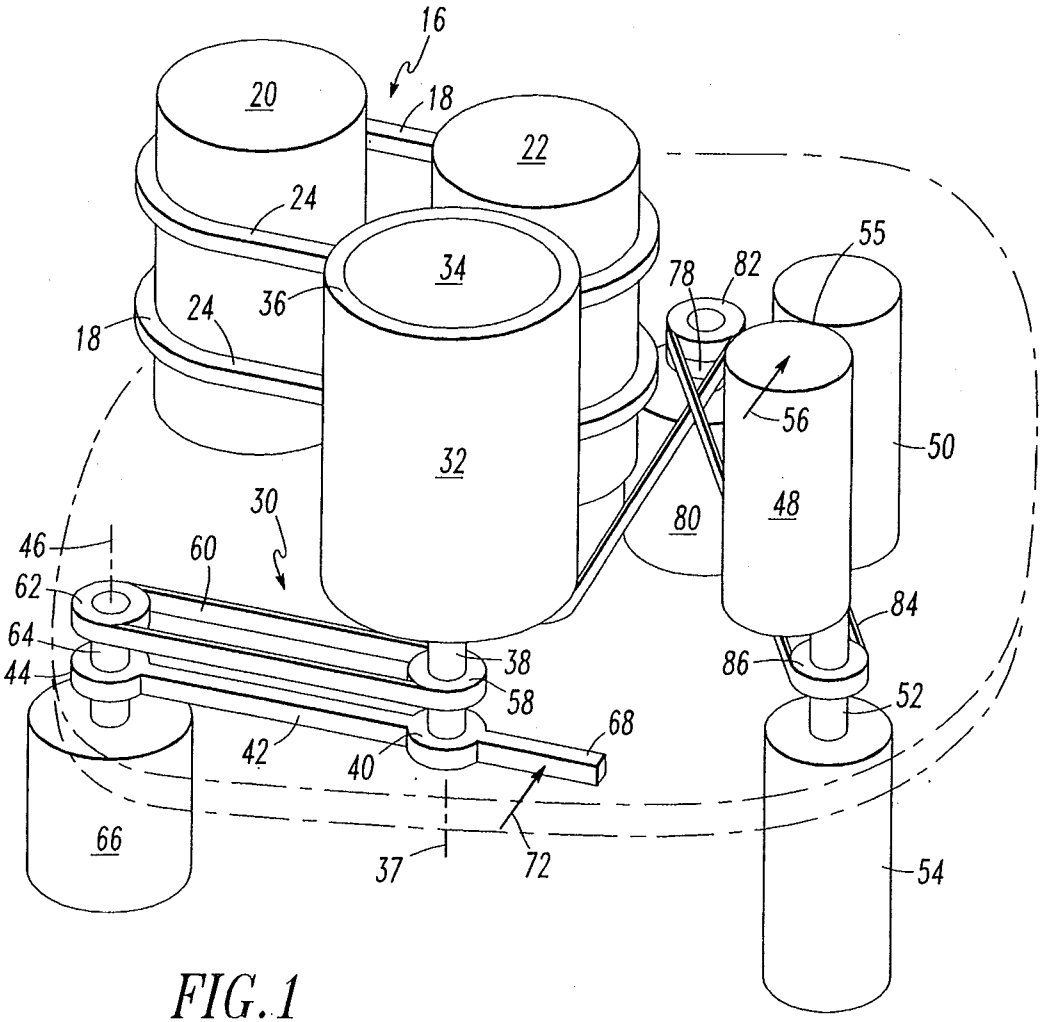
FIG. 1 is a schematic perspective view illustrating the general relationship of components in an exemplary embodiment of the invention.
Figure 3:
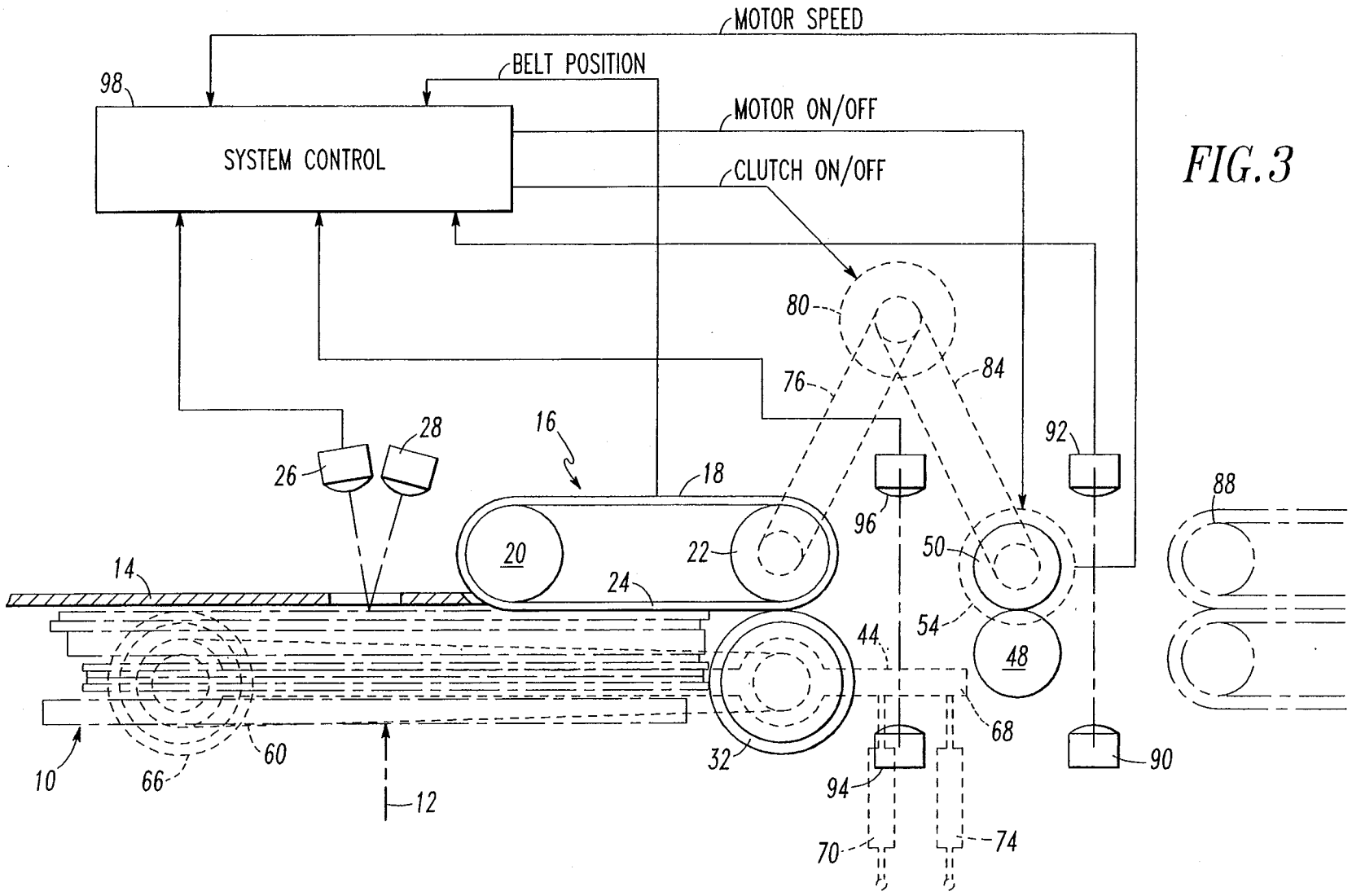
FIG. 3 is a plan view of the embodiment shown in FIGS. 1 and 2 further including a control system in block diagram form.

In the illustrated embodiment and as shown in FIGS. 1–3, a stack of random thickness flat articles is generally designated by the reference numeral 10 in FIG. 3. The stack is arranged such that the articles lie on one side edge and are advanced horizontally by a follower not illustrated as such in FIG. 3, but represented by the arrow 12. The horizontal orientation of the stack 10 is preferred because the normal friction force between the respective articles in the stack may be controlled independently of the weight of the articles. Also, the handling of articles of widely varying widths is facilitated because the bottom edges of all articles are aligned by gravity. The stack is biased so that a single article at the end of the stack engages a stop plate 14 or its equivalent. A pick-off device 16 is provided with a pair of endless friction belts 18 trained about spaced rollers 20 and 22. The belts 18 extend through a flight portion 24 which defines a friction surface positioned slightly ahead of the stop plate 14 in a manner such that the end-most article in the stack 10 will firmly engage the flight portions 24 on the endless belts 18. The presence of a stack against the pick-off device 16 is detected by a photosensor 26 capable of detecting light originating in a lamp 28 and reflected from the end-most article in the stack 10.

In accordance with the invention, an anti-doubling device is provided for restricting advancing movement of more than one article at a time by the pick-off device. Also, the invention includes a delivery device having a drivable friction nip for pulling a separated article from the pick-off device in the direction of article delivery.

In the illustrated embodiment, and as shown most clearly in FIG. 1, the anti-doubling device is generally designated by the reference numeral 30, and includes a friction roller 32 defined by a rotatable roller 34 and an outer cylindrical sleeve 36 of rubberlike friction material. The roller 34 is fixed to rotate with a supporting shaft 38 journaled in a bearing boss 40 formed in an arm 42. The arm 42 is supported for pivotal movement at one end 44 about a pivot axis 46 which is spaced from the axis 37 of the friction roller 32. As such, the friction roller 32 may swing about the axis 46 between a first position of engagement with the active friction flight surfaces 24 of the belts 18 and a second position in which it is spaced from the friction surfaces 24 by the thickness of an article being delivered in a manner which will be understood more fully from the description to follow.

The delivery device in the illustrated embodiment is represented by a pair of pinch rollers 48 and 50. The roller 50 is journaled on a fixed axis and includes a drive shaft 52 extending to an electric servo motor 54. The other roller 48 of the pinch roller pair is spring biased to establish a friction nip 55 with the roller 50, but to be movable away from the roller 50 by the thickness of an article to be delivered. Although the bias of the roller 48 against the roller 50 is not illustrated as such in the drawing, the arrow 56 represents the biassing device by which the roller 48 exerts a pressure nip force against the roller 50.

In accordance with the invention, the anti-doubling device includes means for imposing a constant slip torque, preferably but not exclusively, a magnetic hysteresis device, on the friction roller. In the illustrated embodiment, the shaft 38 of the friction roller 32 is provided with a pulley 58 connected by an endless belt 60 to a pulley 62. The pulley 62 is fixed to a shaft 64 on which the end of the arm 42 is pivotal, as above described. The pulley 62 is fixed to a magnetic hysteresis device 66 by which a constant drag torque may be imposed on the friction roller 32 through the transmission train represented by the pulleys 58 and 62 and belt 60. Such devices are commercially available under the designation "Perma-Tork", the registered trademark of Warner Electric, 449 Gardener Street, South Beloit, Ill. 61080. The available devices have such characteristics as constant torque at variable roller speeds and a facility for adjusting the magnitude of the constant torque.

Swinging movement of the anti-doubling friction roller of the invention between a first position against the friction surfaces of the pick-up device and a second position spaced from those friction surfaces is controlled. In the illustrated embodiment, and as shown most clearly in FIG. 2, the distal end 68 of the arm 42, opposite from the pivoted end 44, is biased by a compression device 70, such as a spring, a low-pressure air cylinder or the like, toward the flights 24 of the belts 18. The direction of such bias is represented by the arrow 72 in FIG. 1. To damp movement of the friction roller 32, a shock absorber 74 is also provided at the distal end 68 of the arm 42. Although not illustrated in FIG. 2, both the compression device 70 and the shock absorber 74 extend to pivotal connections with a fixed frame portion of the apparatus. Also, because the hysteresis device 66 does not swing with the friction roller 32, the inertial mass of moving parts in the anti-doubling device is minimized.

As indicated above, the friction surface of the pick-off device of the present invention is drivable in the direction of article delivery. In the illustrated embodiment, the roller 22 of the pick-off device 16 is drivably connected by an endless belt 76 to one of two pulleys 78 on a one-way clutch 80. The other pulley 82 associated with the clutch 80 is connected by an endless drive belt 84 to a pulley 86 keyed to the shaft 52 of the drive motor 54. The clutch 80 is an electrically actuated clutch which may be adjusted between on/engage and off-/disengage conditions. In light of this drive system, when the motor 54 is turned on, the pinch roller pair will be driven at all times. The pick-off device 16, on the other hand, may be driven in the direction of delivery, or not so driven with the motor 54 turned on, depending on the condition of the clutch 80.

In accordance with the present invention, a control means is provided for operating the pick-off device and the delivery device to position each separated article in the friction nip of the pair of pinch rollers of the delivery device in readiness for delivery, on command, to a transport device.

In the illustrated embodiment and as shown in FIG. 3, the transport device is shown in phantom lines and designated by the reference numeral 88. In practice, the transport device may be any system of conveyance aligned to receive an article fed from the friction nip of the pair of pinch rollers.

In a reference plane normal to the direction of article delivery and between the pair of pinch rollers 48 and 50 and the transport device, is a photoelectric detector including a lamp 90 and a photosensor 92. A similar photodetector is provided in a second reference plane normal to the direction of delivery and between the pick-off device and the delivery device represented by the pair of pinch rollers 48 and 50. In this instance, a lamp 94 cooperates with a photosensor 96. The condition of the photosensors 92 and 96 is fed to a system control 98 which, in practice, may be a computer that is programmed to effect the operation of the apparatus in a manner to be described. In similar fashion, the photosensor 26 of the stack sensing device is input to the system control 98. Other parameters input to the control system are the position of the belts 18 of the pick-off device 16 and the speed of the motor 54. These parameters are represented by legend in the illustration of FIG. 3, and as inputs to the system control. Outputs from the system control 98 include a motor on/off control function and a clutch on/off function as represented by legend in FIG. 3.

Figure 4:
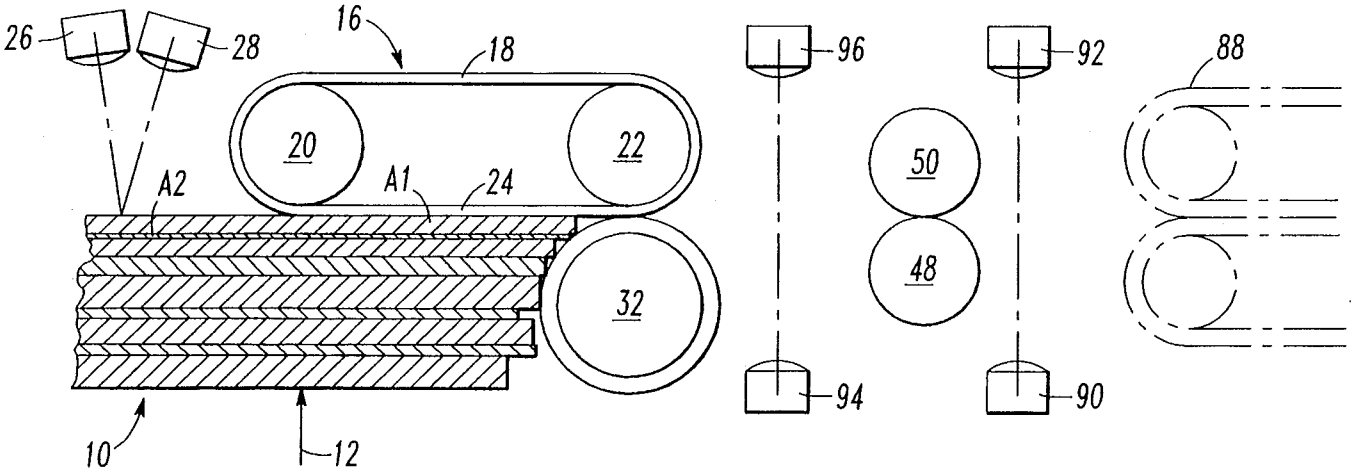
FIGS. 4, 5, 6, and 7 are schematic plan views depicting successive steps in the operation of the illustrated embodiment.
Figure 5:
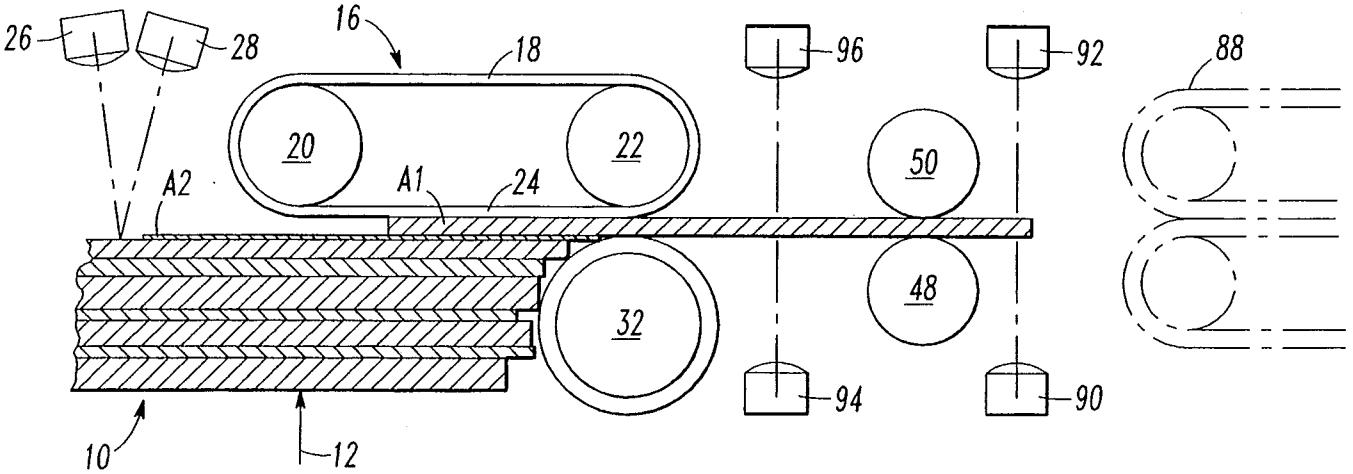

The operation of the apparatus of the invention to separate an article from the end of the stack 10 and deliver each article successively to the transport device 88 may be understood by reference to FIGS. 4–7 of the drawings. In FIG. 4, the apparatus is in readiness to stage an article for delivery on command to the transport device 88. In particular, the photosensor 26 indicates the existence of the stack 10. The end-most article A1 is engaged in frictional contact with the belts 18 of the pick-off device 16. On command to stage an article, the motor 54 is turned on and the clutch 80 is also turned on or engaged. As a result, the pair of pinch rollers will be driven in rotation and the belts 18 will be driven to advance the article A1 toward the transport device 88. At this time, the friction roller 32 of the anti-doubling device separates from the rollers by the thickness of the article A1 and imposes a frictional drag on the second article A2 in the stack. The article A2 is thus prevented from passing between the belts 18 and the friction roller toward the pinch roller pair. When the article A1 is advanced between the pair of pinch rollers 48 and 50 to break the light path between the lamp 90 and the photosensor 92 as shown in FIG. 5, the motor 54 is turned off and the article A1 is staged. During the ensuing waiting interval of time, the clutch 80 remains on or engaged.

After the staged wait period, the system control 98 commands the feed of the article A1 to the transport device 88. Although the motor is commanded to rotate to a running speed, the inertia of the article will require an acceleration of both the pair of pinch rollers 48 and 50 and the belt 18. When the motor 54 reaches its running speed and the distance the belts 18 have traveled is equal to the length of the shortest article in the stack 10, the clutch 80 is disengaged. To the extent that the article A1 remains between the belts 18 and the friction roller 32, the belts will free wheel due to the disengaged condition of the clutch 80.

Figure 6:
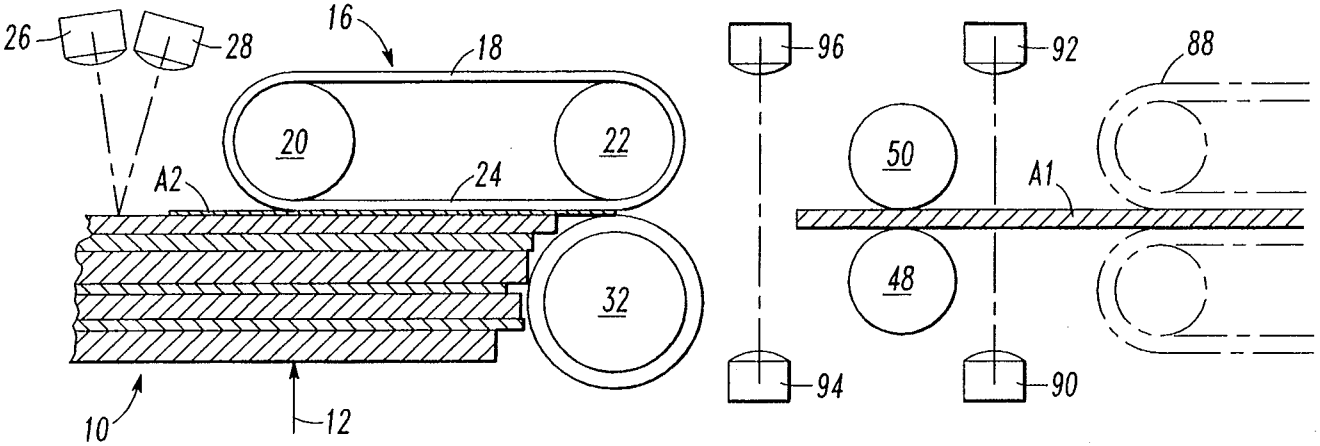
Figure 7:
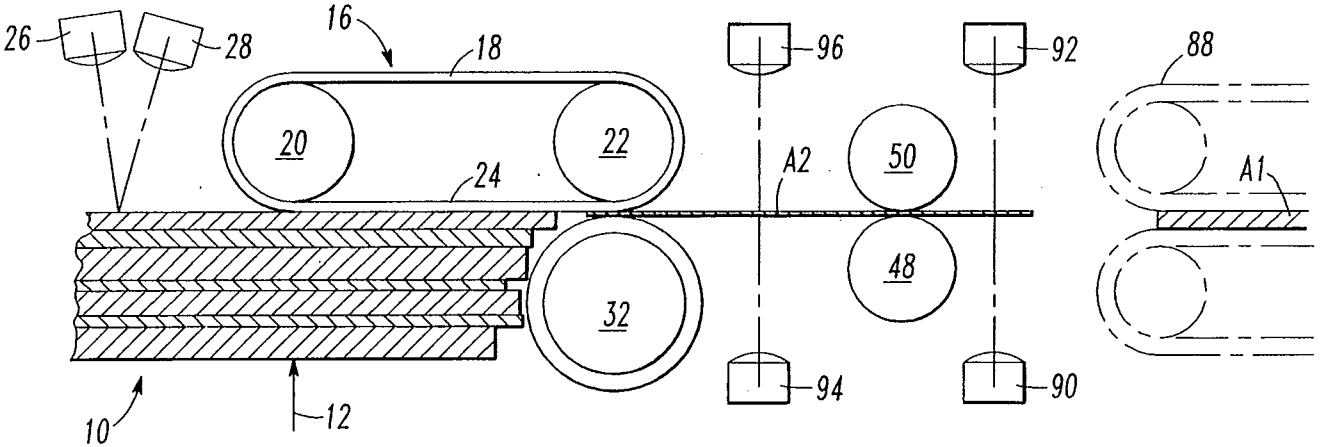

As represented in FIG. 6, when the trailing end of the article A1 passes the light beam between the lamp 94 and the photosensor 96 in the second reference plane, the photosensor indicates a change of state or gap to the system control 98. At the instant of this gap detection, the clutch 80 is turned on or reengaged and a second article A2 is staged in the manner described above with respect to the article A1. The cycle will be repeated for each successive article until the photodetector 26 indicates the absence of a stack 10 to the system control 98.

By restricting the distance of belt travel in the pick-off device 16 to the length of the shortest article present in a given stack or batch of articles to be separated and fed to the transport device 88, the pinch rollers pull longer articles from the pick-off device 16 against the drag torque imposed on the friction roller 32. If the article so pulled is of the shortest length, staging of the next article will not occur until a gap after the trailing edge of the shortest article is sensed by the photosensor 96. The system control 98 may be either calibrated for the length of the shortest anticipated article or programmed to account for different "shortest lengths."

It will be apparent to those skilled in the art that various modifications and variations can be made in the apparatus of the present invention and in construction of this apparatus without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. Apparatus for separating individual flat articles of random thickness from one end of a stack of such articles and delivering separated articles, on command, to a transport device, said apparatus comprising:

a pick-off device having a friction surface drivable in a direction of article delivery and oriented to engage an exposed surface on one article of random thickness at the one end of the stack and advance said one article in the direction of delivery;

an anti-doubling device including a single roller having a friction surface selectably engagedly drivable only in the direction of article delivery for restricting advancing movement of other articles by said pick-off device;

a delivery device having a drivable friction nip for pulling a separated article from said pick-off device in the direction of article delivery;

means for operating said pick-off device and said delivery device to position each separated article in said friction nip in readiness for delivery, on command, to the transport device;

said means for operating said pick-off device and said delivery device further comprising an article sensing device having first and second states to indicate respectively, the absence and presence of an article in a reference plane normal to the direction of article delivery, the reference plane being located downstream from said delivery device and upstream from the transport device; and means for interrupting operation of the delivery device in response to a change of the sensing device from said first state to said second state.

2. The apparatus recited in claim 1 wherein said means for operating said pick-off device and said delivery device further comprises a second article sensing device to indicate respectively, the absence and presence of an article in a second reference plane located between said pick-off device and said delivery device, and means for initiating operation of the pick-off device and the delivery device in response to the absence of an article in said second reference plane.

3. The apparatus recited in claim 1 wherein said pick-off device comprises at least one friction belt trained about a pair of spaced rollers to provide said friction surface and wherein said delivery device comprises a pair of pinch rollers to provide said friction nip.

4. The apparatus recited in claim 3 wherein said means for operating said pick-off device and said delivery device comprises a motor for driving said pair of pinch rollers and a releasable coupling connecting said motor to said pick-off device.

5. The apparatus recited in claim 4 wherein said coupling comprises a clutch operable between on/engaged and off/disengaged conditions.

6. The apparatus recited in claim 5 wherein said means for operating said pick-off device and said delivery device further comprises means for sensing the position of said pinch roller pair and means for sensing the speed of said friction belt.

7. The apparatus recited in claim 6 wherein said means for operating said pick-off device and said delivery device includes means for disengaging said clutch when said friction belt has travelled a predetermined distance.

8. The apparatus recited in claim 1 wherein said anti-doubling device comprises a friction roller and means supporting said friction roller for movement between a first position of contact with the friction surface of said pick-off device and a second position separated from the friction surface of said pick-off device by the thickness of an article advanced from the one end of the stack.

9. The apparatus recited in claim 8 including means for imposing a constant slip torque on said friction roller.

10. The apparatus recited in claim 9 wherein said means for imposing a constant slip torque comprises a magnetic hysteresis device.

11. The apparatus recited in claim 8 wherein said friction roller has an axis of rotation and wherein said means for supporting said friction roller comprises an arm having one end pivotally supported on a pivot axis spaced from the axis of said friction roller and an opposite end.

12. The apparatus recited in claim 11 including a spring in engagement with said opposite end of said arm to bias said friction roller toward said first position.

13. The apparatus recited in claim 12 including a motion damping device engaging the opposite end of said arm for controlling rate of movement of said friction roller between said first and second positions.

* * * * *